US007365288B2

(12) United States Patent
Bang

(10) Patent No.: US 7,365,288 B2
(45) Date of Patent: Apr. 29, 2008

(54) HEATER ASSEMBLY FOR DRYER

(75) Inventor: Jong Chul Bang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 384 days.

(21) Appl. No.: 11/034,795

(22) Filed: Jan. 14, 2005

(65) Prior Publication Data

US 2006/0026859 A1 Feb. 9, 2006

(30) Foreign Application Priority Data

Aug. 9, 2004 (KR) ..... 10-2004-0062378

(51) Int. Cl.
*H05B 3/06* (2006.01)

(52) U.S. Cl. ..... 219/520; 219/201; 219/532; 219/536; 219/542; 174/138 J

(58) Field of Classification Search ..... 219/520, 219/532, 536, 542, 548, 550, 221; 174/135, 174/138 J, 138 R, 175; 34/601, 603
See application file for complete search history.

(56) References Cited

U.S. PATENT DOCUMENTS 4,268,742 A * 5/1981 Cottrell et al. ..... 219/532
6,108,940 A * 8/2000 St. Louis ..... 34/601
2004/0040947 A1* 3/2004 Cho et al. ..... 219/221

* cited by examiner

*Primary Examiner*—Tu Ba Hoang
*Assistant Examiner*—Leonid Fastovsky
(74) *Attorney, Agent, or Firm*—Birch, Stewart, Kolasch & Birch, LLP

(57) ABSTRACT

A heater assembly for a dryer is stably assembled and reduces noise. The heater assembly for a dryer includes hot wires electrically heated an insulator provided with a groove at the center, having lower and upper portions into which the hot wires are fixed, and a partition plate including an insertion hole into which the insulator is inserted and at least one clamp portion provided at the rim of the insertion hole and fixed into the groove.

11 Claims, 7 Drawing Sheets

HEATER ASSEMBLY FOR DRYER

This application claims the benefit of Korean Application No. P2004-62378 filed on Aug. 9, 2004, which is hereby incorporated by reference as if fully set forth herein.

BACKGROUND OF THE INVENTION

1. Field of the Invention

The present invention relates to a heater assembly, and more particularly to, a heater assembly for a dryer, in which hot wires are stably fixed.

2. Discussion of the Related Art

Generally, a dryer is to dry the laundry using hot air generated from a heater provided therein. Recently, a dryer including a washing function is widely used. Specifically, the heater generates heat if electricity is supplied to coils provided inside the heater, and air is varied to dry hot air of high temperature by heat of the heater while passing the heater.

FIG. 1 is a sectional view illustrating a related art dryer including a washing function.

As shown in FIG. 1, a case 110 is provided outside a dryer 100, and a door 105 is provided at the front of the case 110. A drum 140 in which the laundry is received is rotatably provided inside the case 110. An inner space of the drum 140 is opened and closed by the door 105.

A tub 130 in which washing water is received is provided outside the drum 140. A dry duct 150 provided with a heater H is provided above the tub 130.

Specifically, one side of the dry duct 150 communicates with the inner space of the drum 140 and its other side is provided with a fan ventilating air into the drum 140.

A condenser duct 170 extended up and down is provided at the rear of the tub 130. The upper portion of the condenser duct 170 communicates with the other side of the dry duct 150 and its lower portion communicates with the inner portion of the drum 140.

Specifleally, a condensed water tube 175 is provided at the upper portion of the condenser duct 170 and jets condensed water to lower a temperature of air ascending along the condenser duct 170. A sump 181 is provided at the bottom of the tub 130. The washing water is collected in the sump 181 after washing. A drain pump 180 and a drain hose 182 are provided below the suntp 181 to drain the washing water.

A motor 190 is provided at one side of the bottom of the tub 130 to rotate the drum 140 provided in the tub 130. A central shaft of a pulley 195 connected to the motor 190 and a belt is fixed to the rear of the drum 140.

The operation of the dryer including a washing function will now be described.

First, after the door 105 is opened and the laundry is put into the drum 140, a power source is applied to the dryer. If the rotational force of the motor 190 is transferred to the pulley 195 through the belt, washing of the laundry is performed as the drum 140 is rotated.

Afterwards, after washing the laundry, the washing water is drained out along the drain hose 182 by the drain pump 180.

Meanwhile, if the power source is applied to the fan 160 and the heater H to dry the washed laundry, hot air is supplied into the drum 140.

Specifically, the air inhaled by the fan 160 passes the heater H provided inside the dry duct 150. At this time, air flowing inside the dry duct 150 is varied to dry hot air of high temperature by heat generated from the heater H.

The hot air flown into the drum 140 along the duct 150 absorbs water contained in the laundry rotating inside the drum 140. The air is varied to a wet air of high temperature and then the wet air ascends along the condenser duct 170 connected with the lower portion at the rear ot the drum 140.

The condensed water jetted from the condensed water pipe 175 connected with the upper portion of the condenser duct 170 flows along the inner surface of the condenser duct 170. At this time, the wet air of high temperture is heat-exchanged with the condensed water while ascending upwardly. Thus, the wster contained in the wet air is condensed and is downwardly dropped.

Therefore, the air is varied to a dry air again and is inhaled by the fan 160 so that it circulates inside the drum along the dry duct 150. By contrast, the dropped water is collected in the sump 181 along the inner circumference of the tub 130 and then is drained out.

However, the related art dry has several problems.

Since the heater includes coils heated at high temperature, it is difficult to stably fix the heater into the dry duct.

In addition, since the heater is expanded by heat, coupling between respective parts of the heater becomes loose.

Moreover, noise occurs in the heater due to vibration generated when the air passes the inside of the heater.

SUMMARY OF THE INVENTION

Accordingly, the present invention is directed to a heater assembly for a dryer that substantially obviates one or more problems due to limitations and disadvantages of the related art.

An object of the present invention is to provide a heater assembly for a dryer, which is stably assembled and reduces noise.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a heat assembly for a dryer includes hot wires electrically heated, an insulator provided with a groove at the center, having lower and upper portions into which the hot wires are fixed, and a partition plate including an insertion hole into which the insulator is inserted and at least one clamp portion provided at the rim of the insertion hole and fixed into the groove.

The clamp portion includes an inclined plane projected in an inclined direction to be inserted into the groove while sliding inside the groove as the insulator is rotated. The clamp portion further includes a horizontal plane formed in a horizontal direction at the end of the inclined plane.

The clamp portion is formed in a single body with the partition plate and is projected by foaming. A pair of the clamp portions are formed to oppose each other at the rim of the insertion hole. The groove has an up and down width almost equal to the height of the clamp portion. The partition plate is made of a metal material.

The insulator includes a main body extended up and down and coil winding portions provided at lower and upper portions of the main body to fix the hot wires therein. The coil winding portions have a cylinder shape. The coil winding portions have a thickness tapered toward their end. A loading groove is formed at a point where the coil winding portions join the main body, and the hot wires are inserted into the loading groove. Projections are formed at the rim of the loading groove to prevent the hot wires from being removed from the loading groove. The coil winding portions are provided with an opened portion at the center.

In another aspect, a heater assembly for a dryer includes hot wires electrically heated, an insulator provided with a groove at the center, having lower and upper portions into which the hot wires are fixed, a partition plate including an insertion hole into which the insulator is inserted, and a clamp portion provided at the rim of the insertion hole and projected in an inclined direction to be inserted into the groove while sliding inside the groove as the insulator is rotated.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
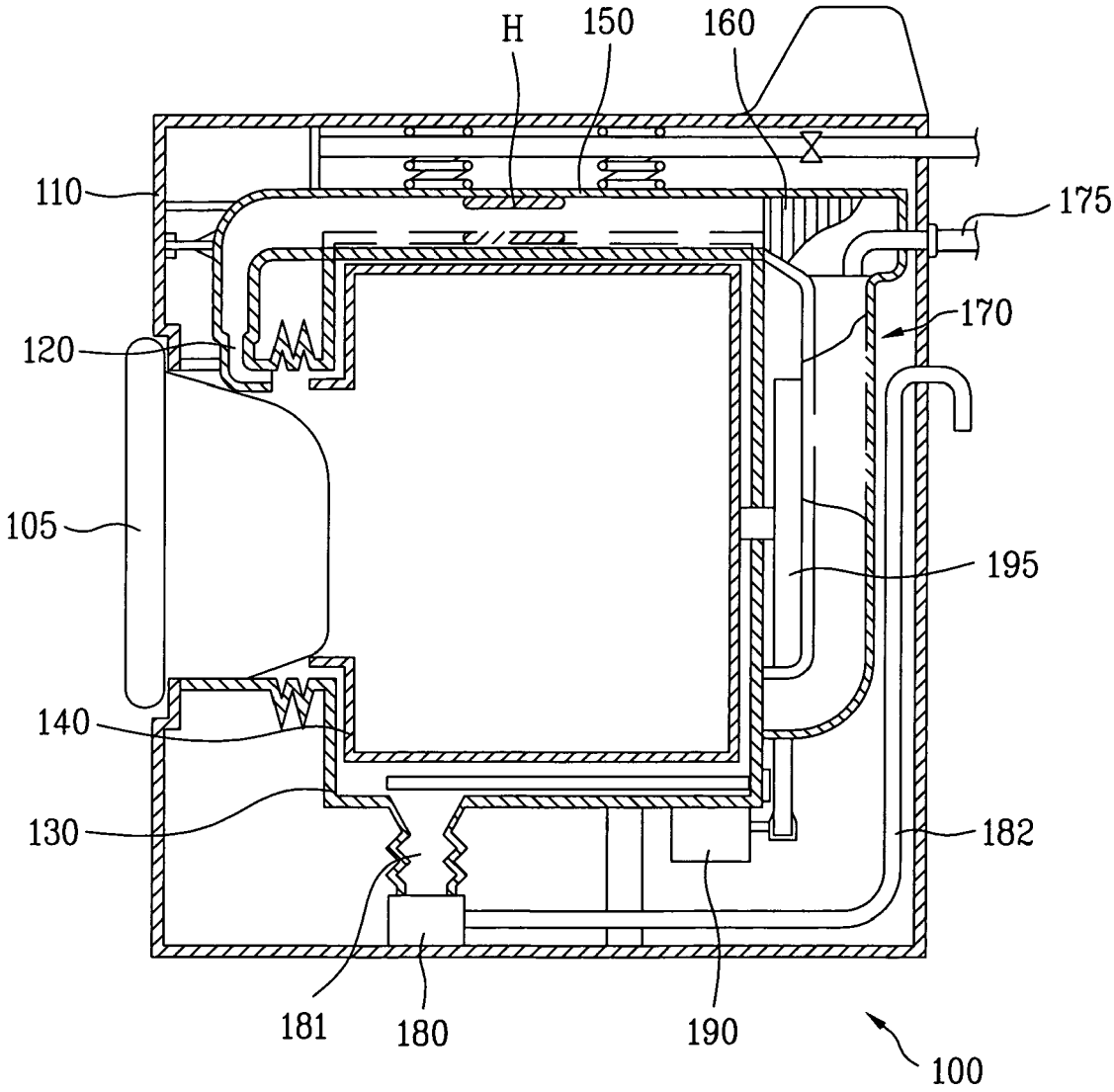
FIG. 1 is a sectional view illustrating a related art dryer including a washing function.
Figure 2:
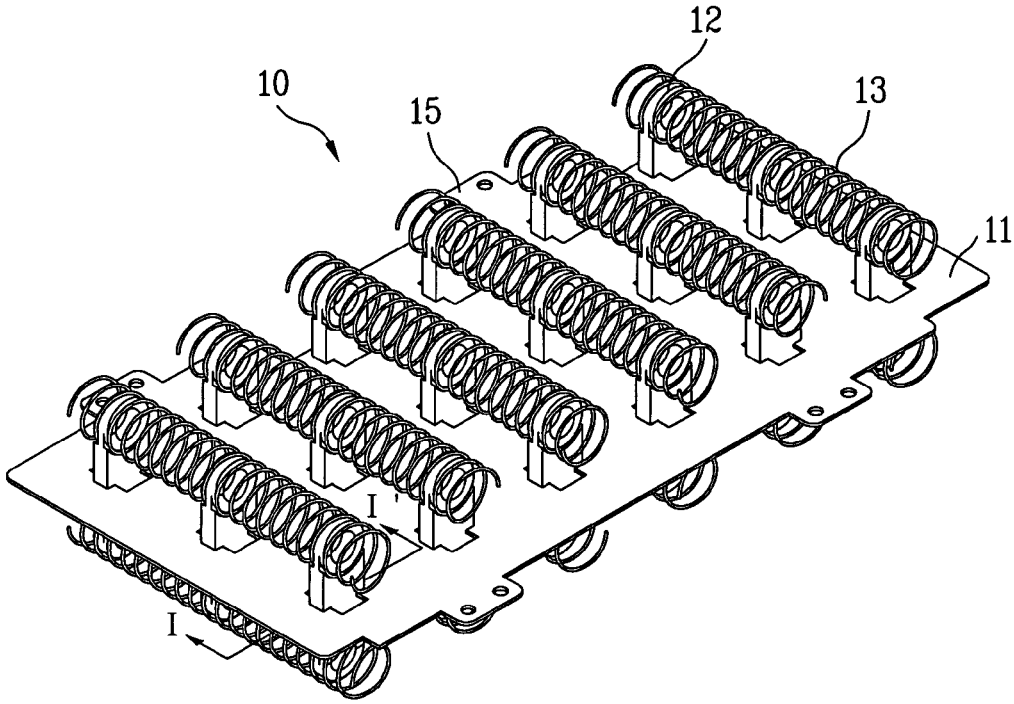
FIG. 2 is a perspective view illustrating a heater assembly according to the first embodiment of the present invention.
Figure 3:
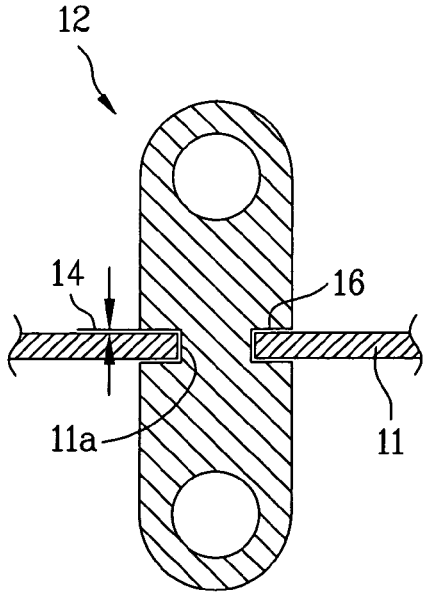
FIG. 3 is a sectional view viewed from a direction I-I' of FIG. 2.

FIG. 2 is a perspective view illustrating a heater assembly according to the first embodiment of the present invention, and FIG. 3 is a sectional view viewed from a direction I-I' of FIG. 2.

As shown in FIGS. 2 and 3, a heater 10 includes hot wires 13 heated by electricity, an insulator 12 made of an insulating material to support the hot wires, and a partition plate 11 partitioning the insulator 12 up and down.

Specifically, the hot wires are wound several times and are arranged in a plurality of rows along a direction of air flowing inside a dry duct. Both ends of the respective hot wire are connected with a power source.

Meanwhile, the insulator 12 supports the hot wires 13 not to droop downwardly and is made of an insulating material to prevent electricity from flowing to the partition plate 11.

The partition plate 11 supports the insulator in an upright direction and at the same time partitions the inside of the dry duct up and down. At least one fitting portion 15 fixed to the dry duct is projected at both sides of the partition plate. The hot wires 13 are fixed to lower and upper portions of the insulator 12.

As shown in FIG. 3, a hole 11*a* is formed in the partition plate, and the insulator is inserted into the hole 11*a*. A groove 16 recessed at a predetermined depth is formed at the center of the insulator 12. The insulator 12 inserted into the hole 11*a* is rotated so that the rim of the hole 11*a* is inserted into the groove 16.

Meanwhile, in the heater 10 according to the first embodiment of the present invention, the thickness of the partition plate 11 is thinner than the width of the groove 16. In this case, a clearance 14 is formed between the rim of the hole 11*a* and the groove 16. Therefore, the insulator 12 is finely vibrated when the air ventilating inside the dry duct passes the heater 10. At this time, noise may occur due to the vibration.

Hereinafter, a dryer having an improved heater according to the second embodiment of the present invention will be described.

Figure 4:
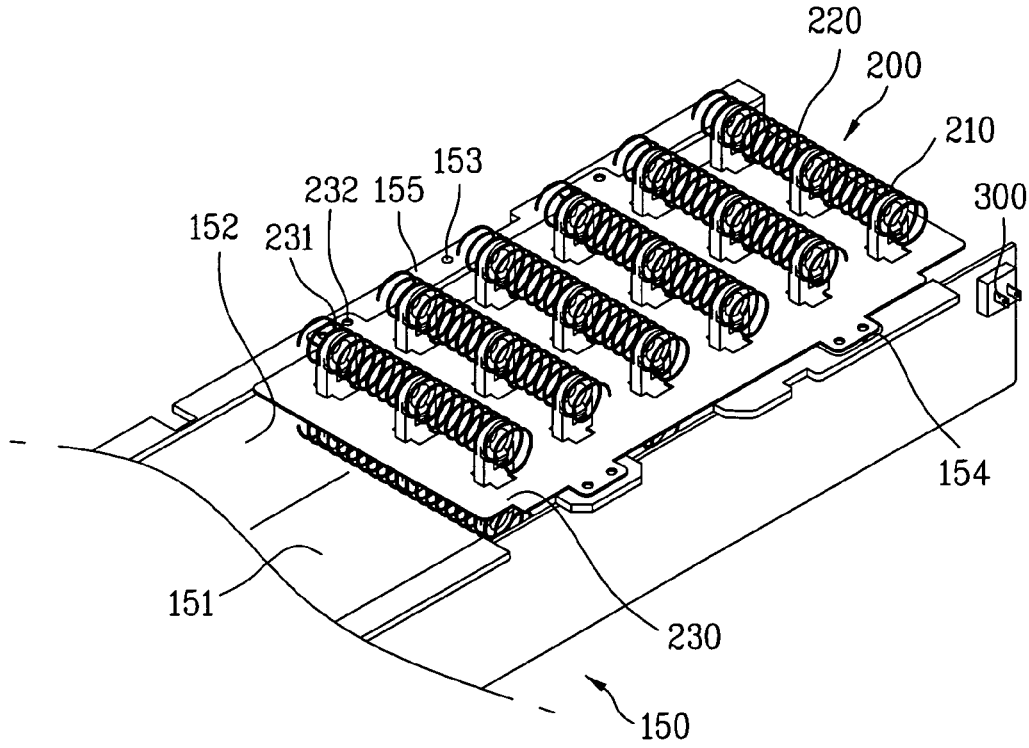
FIG. 4 is a sectional view illustrating a heater assembly provided with an insulator according to the second embodiment of the present invention.

FIG. 4 is a sectional view illustrating a heater assembly according to the second embodiment of the present invention.

As shown in FIG. 4, a heater 200 includes hot wires 220 heated by electricity, an insulator 210 made of an insulating material to support the hot wires, and a partition plate 230 partitioning the insulator 210 up and down.

Specifically, the hot wires 220 are wound several times and are arranged in a plurality of rows along a direction of air flowing inside a dry duct 150. Both ends of the respective hot wire are connected with a contact terminal 300 connected with a power source. The hot wires 220 are respectively provided at lower and upper portions of the insulator 210. A space formed inside the dry duct 150 is partitioned up and down around the partition plate 230.

The insulator 210 supports the hot wires 220 not to droop downwardly and is made of an insulating material to prevent electricity from flowing to the partition plate 230.

Meanwhile, a fitting portion 231 fixed to a dry duct 150 in which the heater 200 is received is projected at both sides of the partition plate 230. At least one fitting hole 232 is formed in the fitting portion 231.

The portion of the dry duct 150, in which the heater is received, is divided into an upper duct and a lower duct. As shown, the lower duct includes a bottom plate 151, a side plate 152 vertically bent at both sides of the bottom plate 151, and an air path. A flange 155 fixed to the fitting portion 231 of the partition plate 230 is formed at the upper portion of the side plate 152. The flange 155 is provided with a groove 154 recessed to load the fitting portion 231. A hole formed in the groove 154 is fixed to the fitting hole 232 formed in the fitting portion 231 by a fitting member.

Also, the flange 155 is provided with a duct fitting hole 153. The hole 153 is to be fixed to a hole formed in the upper duct (not shown) by the fitting member.

As described above, the air inhaled into the dry duct 150 by the fan 160 is heated while passing the heater 200. The heated air is supplied into the drum in which the laundry is received.

Figure 5:
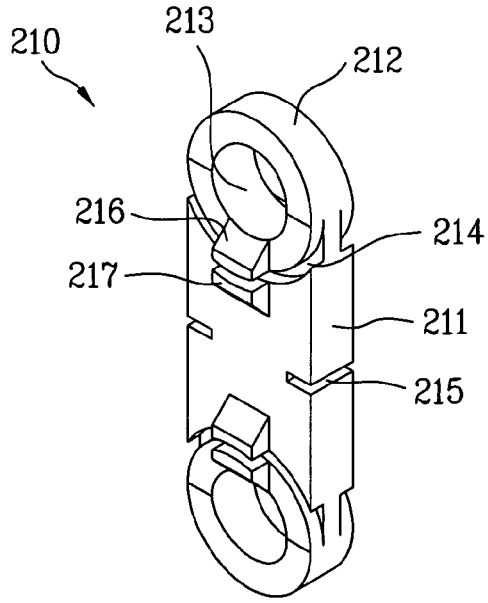
FIG. 5 is a perspective view illustrating an insulator according to the present invention.

FIG. 5 is a perspective view illustrating the insulator according to the second embodiment of the present invention.

As shown in FIG. 5, the insulator 210 includes a main body 211 of an electrical insulating material and coil winding portions 212. A groove 215 recessed at a predetermined depth is formed at the center of the main body 211, and the coil winding portions 212 are provided at lower and upper portions of the main body 211 in a circular shape having a predetermined diameter.

A loading groove 214 recessed at a predetermined depth along the circumference of the coil winding portions 212 is formed at a point where the main body 211 joins the coil winding portions 212. The hot wires are wound along the loading groove 214. Preferably, the loading groove 214 has a thickness almost equal to that of the hot wires. This is to prevent the hot wires fitted into the loading groove 214 from being removed from the loading groove 214 even in case that the hot wires are expanded by heat.

Furthermore, to reduce the material cost, an opened portion 213 is formed at the center of the coil winding portions 212 to constitute a cylinder shape as a whole. Preferably, the coil winding portions 212 are tapered toward the end. That is, the sides of the coil winding portions 212 are inclined. This is because that the hot wires can easily be provided in the coil winding portions while sliding downwardly along the inclined plane.

If the outer diameter of the coil winding portions 212 is smaller than the inner diameter of the hot wires, it is likely that the hot wires are removed from the coil winding portions. To avoid this, the outer diameter of the coil winding portions 212 is at least equal to or greater than the inner diameter of the hot wires. Moreover, if the thickness of the coil winding portions is thinner than the pitch of the hot wires, it is difficult to wind the hot wires in the coil winding portions. Therefore, it is preferable that the thickness of the coil winding portions is greater than or at least equal to the pitch of the hot wires.

Meanwille, projections 216 and 217 outwardly projected are formed at the rim of both sides of the loading groove 214. Specifically, since the depth of the loading groove 214 is similar to the diameter of the hot wires, it is likely that the hot wires may not be prevented from being removed from the loading groove 214 when the hot wires are expanded by heat. The projections 216 and 217 are to prevent the hot wires from being removed from the loading groove 214.

Preferably, to reduce the material cost, the projections 216 and 217 are inclined as they are spaced apart from the loading groove 214.

Figure 6:
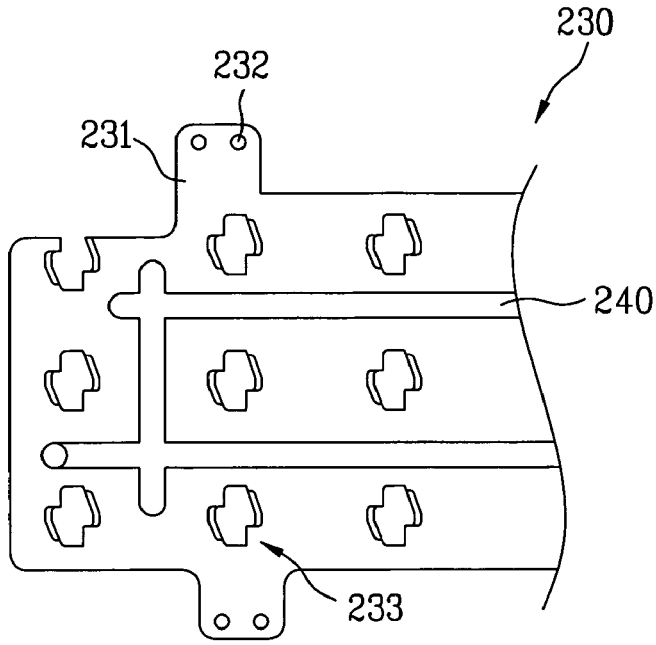
FIG. 6 is a partially enlarged view illustrating a partition plate according to the present invention.
Figure 7:
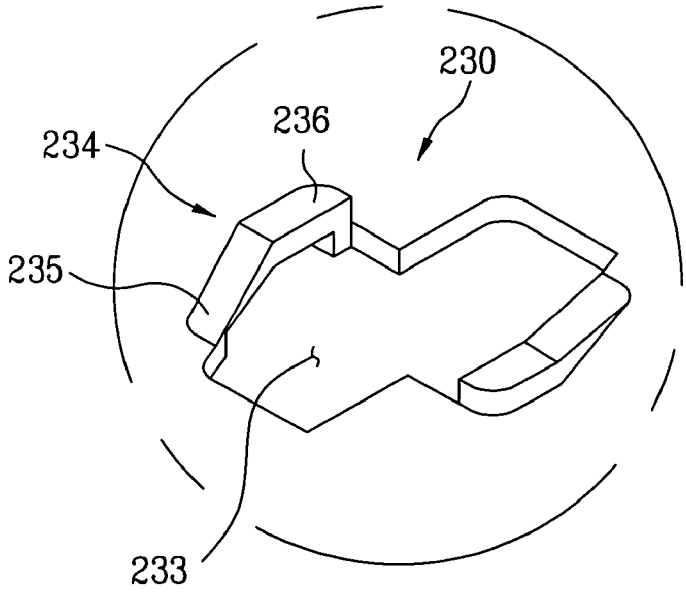
FIG. 7 is an enlarged perspective view illustrating an insulator insertion hole formed in the partition plate.
Figure 8:
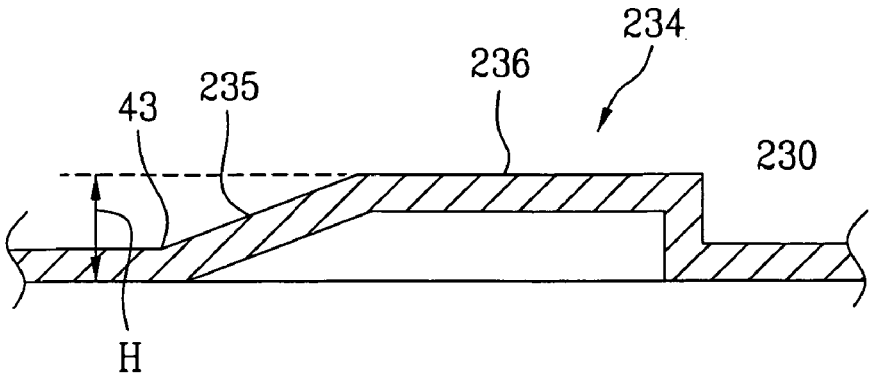
FIG. 8 is a sectional view illustrating a clamp portion formed at the rim of the insertion hole.
Figure 9:
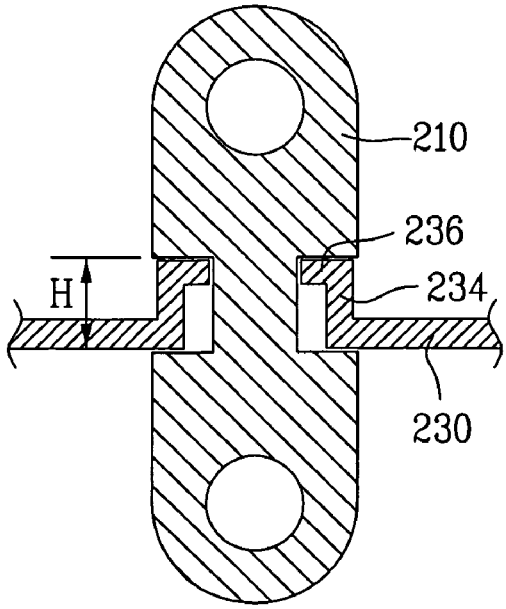
FIG. 9 is a sectional view illustrating the state that the insulator is fixed to the insertion hole.
Figure 10:
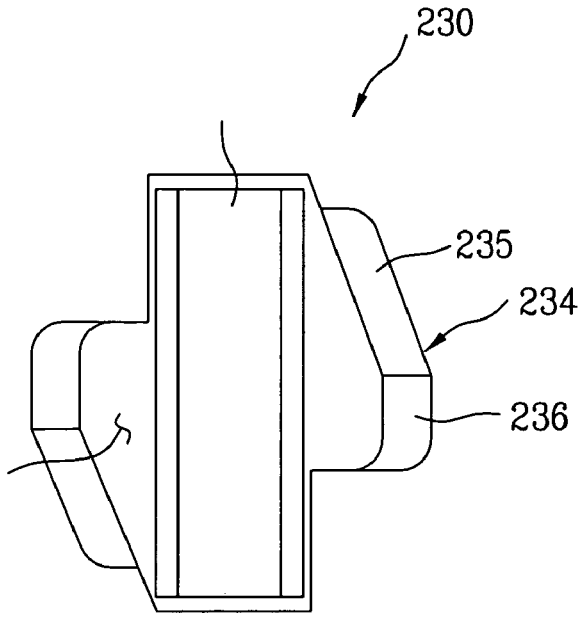
FIG. 10 to FIG. 13 illustrate the steps of fixing the insulator according to the present invention.
Figure 11:
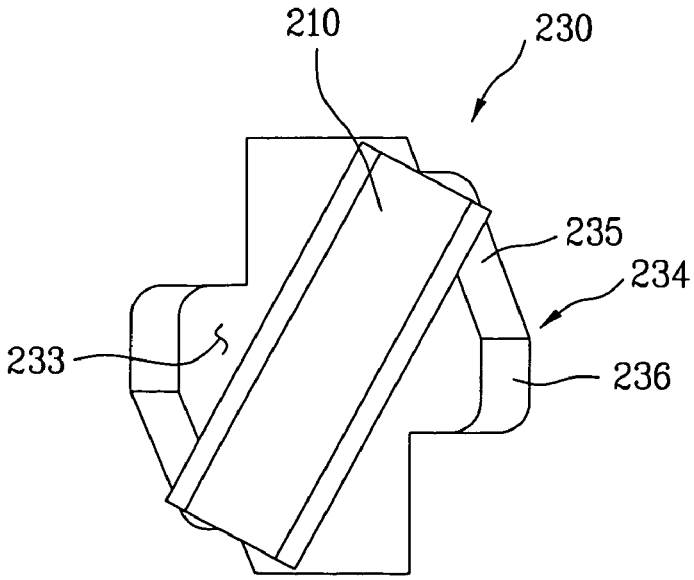
Figure 12:
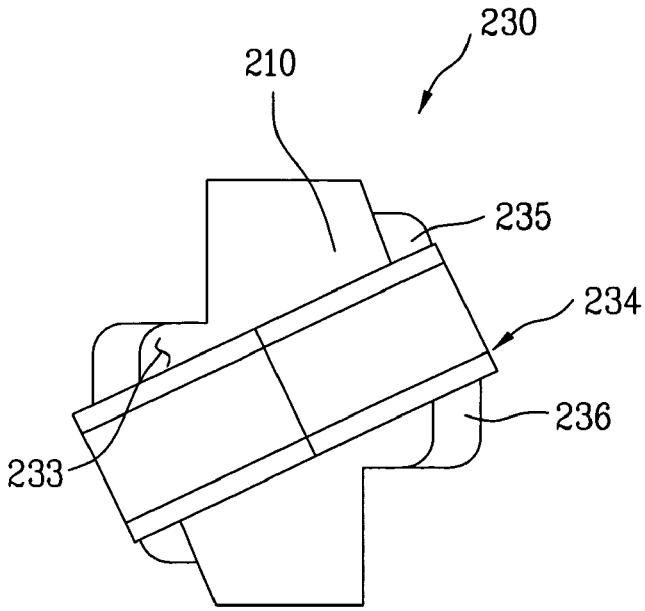

FIG. 6 is a partially enlarged view illustrating the partition plate according to the present invention, FIG. 7 is an enlarged perspective view illustrating an insulator insertion hole formed in the partition plate, FIG. 8 is a sectional view illustrating a clamp portion formed at the rim of the insertion hole, and FIG. 9 is a sectional view illustrating the state that the insulator is fixed to the insertion hole.

As shown in FIG. 6, the fitting portion 231 is provided at a side of the partition plate 230. The fitting portion 231 is projected at a predetermined length and is fixed to the duct. At least one fitting hole 232 is formed in the fitting portion 231. An insulator insertion hole 233 is formed in the partition plate 230.

As shown in FIG. 7, the insertion hole 233 is formed in such a manner that the respective insulator is inserted into the insertion hole 233 in a state that a plurality of the insulators are aligned in one direction. The rim of the insertion hole 233 is inserted into the groove 215 of FIG. 5 when the insulator 210 is rotated. In this case, a clamp portion 234 is respectively formed at both sides of the rim of the insertion hole 233. The clamp portion 234 may be formed separately from the partition plate 230 made of metal material. Alternatively, the clamp portion 234 may be formed in a single body with the partition plate 230. Preferably, the clamp portion 234 is formed by foaming.

As shown in FIG. 8, the clamp portion 234 includes an inclined plane 235 and a horizontal plane 236. The inclined plane 235 is projected upwardly or downwardly so that it is inclined at a predetermined angle from the partition plate 230. The horizontal plane 236 is horizontally formed at the end of the incline plane 235. Preferably, the inclined plane 235 is inclined or rounded along a rotational radius of the insulator 210 when viewed from the top.

Referring to FIGS. 8 and 9, the clamp portions 234 at both sides of the insertion hole oppose each other, and the insulator 210 is rotated at an angle of 180° after it is inserted into the insertion hole 233. At this time, the upper portion inside the groove 215 formed at the center of the insulator 210 ascends while sliding along the inclined plane 235. If the upper portion of the groove 215 reaches the end of the inclined plane 235, it adjoins the horizontal plane 236. Also, the lower portion inside the groove 215 adjoins the bottom of the partition plate 230.

The clamp portion 234 is made of a thin plate having elasticity. The horizontal plane 236 of the clamp portion is tightly in contact with the upper portion inside the groove 215. Therefore, the insulator 210 is stably supported.

As shown in FIG. 9, since the lower and upper portions of the groove 215 formed in the insulator 210 are firmly supported by the clamp portion 234, the insulator 210 is prevented from being vibrated.

FIG. 10 to FIG. 13 illustrate the steps of fixing the insulator according to the present invention.

Referring to FIG. 10 to FIG. 13, after the insulator 210 is inserted into the insertion hole 233 of the partition plate 230, the clamp portion 234 is inserted into the groove 215 if the insulator 210 is rotated clockwise or counterclockwise. The upper portion of the groove 215 is slid along the inclined plane 235.

Figure 13:
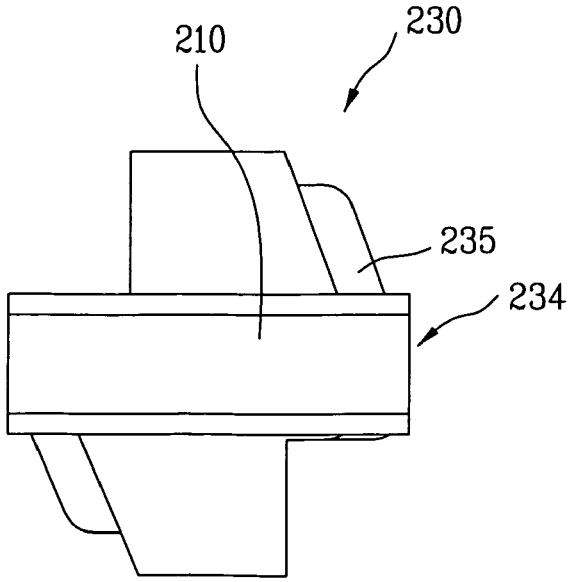

If the insulator 210 is rotated at an angle of 90°, as shown in FIG. 13, the horizontal plane 236 of the clamp portion 234 is tightly in contact with the upper portion of the groove 215. The insulator is fixed in a state that the upper portion of the groove 215 is in contact with the horizontal plane 236. Also, the bottom of the partition plate 230 is tightly in contact with the lower portion of the groove 215.

In this case, it is preferable that the height H of the clamp portion 234 is equal to or greater than the up and down width of the groove 215 to stably fix the clamp portion 234 to the groove 215. Preferably, the clamp portion 234 is made of metal. The clamp portion 234 is more firmly fixed to the groove 215 if it is expanded by heat.

As described above, the hot wires can easily be fixed to the insulator of the heater according to the present invention.

Also, since the hot wires can stably be fixed to the insulator, they are prevented from being removed from the insulator when the heater is heated.

Moreover, since the insulator is firmly supported by the clamp portion of the partition plate, it is possible to prevent the insulator from being vibrated due to the air flowing into the duct. Therefore, it is possible to remove noise generated by the vibration of the insulator.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A heater assembly for a dryer comprising:

hot wires electrically heated; an insulator provided with a groove at the center, having lower and upper portions into which the hot wires are fixed;

and a partition plate including an insertion bole into which the insulator is inserted and at least one clamp portion provided at the rim of the insertion hole and fixed into the groove, wherein the clamp portion has an inclined surface projected in an inclined direction at a predetermined angle from the said partition plate on which an upper surface of the groove is slidably engageable and a level surface horizontally formed at the upward end of said incline surface on which the upper surface of the groove is further slidably engageable to come into tight contact with substantially all of the upper surface of the groove to provide a stable support on which the upper surface of the groove rests.

2. The heater assembly for a dryer of claim 1, wherein the clamp portion is formed in a single body with the partition plate.

3. The heater assembly for a dryer of claim 1, wherein a pair of the clamp portions are formed to oppose each other at the rim of the. insertion hole.

4. The heater assembly for a dryer of claim 1, wherein the groove has an up and down width almost equal to the height of te clamp portion.

5. The heater assembly for a dryer of claim 1, wherein the partition plate is made of a metal material.

6. The heater assembly for a dryer of claim 1, wherein the insulator includes a main body extended up and down and coil winding portions provided at lower and upper portions of the main body to fix the hot wires therein.

7. The heater assembly for a dryer of claim 6, wuerem the coil winding portions have a cylinder shape.

8. The heater assembly for a dryer of claim 6, wherein the coil winding portions have a thickness tapered toward their end.

9. The heater assembly for a dryer of claim 6, wherein a loading groove is formed at a point Where the coil winding portions join he main body, and the hot wires are inserted into the loading groove.

10. A heater assembly for a dryer comprising:

hot wires electrically heated;

an insulator provided with a groove at the center, having lower and upper portions into which the hot wires are fixed; and a partition plate including an insertion hole into which the insulator is inserted and at least one clamp portion provided at the rim of the insertion hole and fixed into the groove wherein (1) the insulator includes a main body extended up and down and coil winding portions provided at lower and upper portions of the main body to fix the hot wires therein, (2) a loading groove is formed at a point where the coil winding portions join the main body, and the hot wires are inserted into the loading groove and (3) projections are formed at the rim of the loading groove to prevent the hot wires from being removed from the loading groove.

11. The heater assembly for a dryer of claim 6, wherein, the coil winding portions are provided with an opened portion at the center.

* * * * *